US009141023B2

(12) United States Patent
Sugiyama et al.

(10) Patent No.: US 9,141,023 B2
(45) **Date of Patent: *Sep. 22, 2015**

(54) IMAGE FORMING DEVICE WITH EXPOSURE UNIT AND PRESSING MEMBER

(71) Applicant: Brother Kogyo Kabushiki Kaisha, Nagoya-shi, Aichi-ken (JP)

(72) Inventors: Yosuke Sugiyama, Gifu (JP); Junichi Yokoi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/218,209

(22) Filed: Mar. 18, 2014

(65) Prior Publication Data

US 2014/0198169 A1 Jul. 17, 2014

Related U.S. Application Data

(63) Continuation of application No. 12/394,795, filed on Feb. 27, 2009, now Pat. No. 8,698,860.

(30) Foreign Application Priority Data

Feb. 29, 2008 (JP) ..... 2008-049324

(51) Int. Cl.
*B41J 2/385* (2006.01)
*G03G 13/04* (2006.01)
(Continued)

(52) U.S. Cl.
CPC ..... *G03G 15/04054* (2013.01); *B41J 2/447* (2013.01); *G03G 21/1647* (2013.01);
(Continued)

(58) Field of Classification Search
USPC ..... 347/138
See application file for complete search history.

(56) References Cited

U.S. PATENT DOCUMENTS 5,376,994 A * 12/1994 Mama et al. ..... 399/93
5,704,810 A 1/1998 Shimasaki
(Continued)

FOREIGN PATENT DOCUMENTS

JP 61-095956 A 5/1986
JP 62-175782 A 8/1987
(Continued)

OTHER PUBLICATIONS

Notification of Reasons for Refusal for corresponding Japanese Application No. 2007-335771 mailed Nov. 22, 2011.
(Continued)

*Primary Examiner* — Jannelle M Lebron
*Assistant Examiner* — Jeremy Bishop
(74) *Attorney, Agent, or Firm* — Banner & Witcoff, Ltd.

(57) ABSTRACT

An image forming device includes a photoconductive body, an exposure unit configured with a plurality of light emitting elements aligned in a predetermined direction, the exposure unit being adopted to expose the photoconductive body to light emitted by the light emitting elements, a frame configured to support both sides of the exposure unit in the predetermined direction, the frame having a reference portion configured to position the exposure unit in the predetermined direction in contact with an end of the exposure unit in the predetermined direction, and a pressing member provided to one of the frame and the exposure unit, the pressing member being configured to press the end of the exposure unit against the reference portion.

9 Claims, 7 Drawing Sheets

(51) Int. Cl.

| | |
|---|---|
| ***G03G 15/04*** | (2006.01) |
| ***B41J 2/447*** | (2006.01) |
| ***G03G 21/16*** | (2006.01) |

(52) U.S. Cl.
CPC .... *G03G21/1666* (2013.01); *G03G 2221/1636* (2013.01); *G03G 2221/1654* (2013.01); *G03G 2221/1678* (2013.01)

(56) References Cited

U.S. PATENT DOCUMENTS

| | | | | |
|---|---|---|---|---|
| 5,870,659 | A | 2/1999 | Maruyama et al. | |
| 6,538,679 | B2 * | 3/2003 | Hiyoshi | 347/138 |
| 6,545,693 | B2 * | 4/2003 | Kitayama et al. | 347/138 |
| 6,681,088 | B2 * | 1/2004 | Kanno et al. | 399/111 |
| 6,809,752 | B2 * | 10/2004 | Nagamine | 347/238 |
| 6,995,782 | B2 * | 2/2006 | Oda et al. | 347/138 |
| 7,154,525 | B2 | 12/2006 | Oda et al. | |
| 7,589,751 | B2 | 9/2009 | Fukutome et al. | |
| 7,825,946 | B2 | 11/2010 | Sugiyama et al. | |
| 7,982,761 | B2 | 7/2011 | Yokoi | |
| 8,698,860 | B2 * | 4/2014 | Sugiyama et al. | 347/138 |
| 2005/0094217 | A1 | 5/2005 | Molchan et al. | |
| 2007/0126852 | A1 * | 6/2007 | Fukutome et al. | 347/262 |
| 2009/0162091 | A1 | 6/2009 | Yokoi | |
| 2009/0169260 | A1 | 7/2009 | Yokoi | |
| 2009/0274488 | A1 | 11/2009 | Sugiyama | |
| 2009/0322851 | A1 | 12/2009 | Yokoi et al. | |

FOREIGN PATENT DOCUMENTS

| | | | |
|---|---|---|---|
| JP | 63-018367 | A | 1/1988 |
| JP | 63-161740 | U | 10/1988 |
| JP | 01-093763 | A | 4/1989 |
| JP | 10-078686 | A | 3/1998 |
| JP | 2000-267033 | A | 9/2000 |
| JP | 2002-031856 | A | 1/2002 |
| JP | 2003-112446 | A | 4/2003 |
| JP | 2004-295147 | A | 10/2004 |
| JP | 2006-088598 | A | 4/2006 |
| JP | 2006-145759 | A | 6/2006 |
| JP | 2007-065125 | A | 3/2007 |
| JP | 2007-069528 | A | 3/2007 |
| JP | 2007-293063 | A | 11/2007 |

OTHER PUBLICATIONS

Office Action received in Japanese Application No. 2008-049324 mailed Mar. 2, 2010.
Communication in Japanese Application No. 2008-049324 mailed Jan. 11, 2011.
Notice of Allowance issued in related U.S. Appl. No. 13/167,454 mailed Jan. 17, 2013.
Non-Final Office Action issued in related U.S. Appl. No. 13/167,454 mailed Aug. 3, 2012.
Non-final Office Action received in U.S. Appl. No. 13/167,454 mailed May 2, 2013.
Notice of Allowance issued in U.S. Appl. No. 13/167,454 mailed Dec. 5, 2013.
Apr. 3, 2015—(US) Notice of Allowance—U.S. Appl. No. 14/223,000.

* cited by examiner

40
UPSIDE
FRONT
RIGHT
DOWNSIDE
LEFT
REAR
48
48A
48B
49
42F
42E
42D
42C
42B
42
42A
41
41A
43
43A
44
45
45A
45B
45D
45E
100
101
102
42G 44A
44B
44C
44D
43B

IMAGE FORMING DEVICE WITH EXPOSURE UNIT AND PRESSING MEMBER

CROSS-REFERENCE TO RELATED APPLICATION

This application is a continuation of U.S. patent application Ser. No. 12/394,795 filed Feb. 27, 2009, which claims priority under 35 U.S.C. §119 from Japanese Patent Application No. 2008-049324 filed on Feb. 29, 2008. The entire contents of the above-noted applications are incorporated herein by reference.

BACKGROUND

1. Technical Field

The following description relates to one or more image forming devices configured to perform an exposure operation with an LED head having a plurality of LEDs.

2. Related Art

In general, an image forming device is configured to form a desired image on a sheet by exposing a charged photoconductive drum to light to form an electrostatic latent image on the photoconductive drum, supplying developer to the electrostatic latent image to form a developer image, and transferring the developer image onto the sheet. As such an image forming device, a device has been known that includes an LED head with a plurality of LEDs for exposing the photoconductive drum to light and a pair of main body frames adopted to support both ends in a longitudinal direction of the LED head (in which the LEDs are aligned) (see Japanese Patent Provisional Publication No. SHO61-95956).

SUMMARY

However, according to the known device, the LED head has to be positioned and fixed relative to the main body frames in the longitudinal direction of the LED head in order to prevent fluctuation of an exposed position in an axial direction of the photoconductive drum in which position the photoconductive drum is exposed to the light.

Aspects of the present invention are advantageous to provide one or more improved image forming devices adopted to position an exposure unit relative to main body frames in a longitudinal direction of the exposure unit.

According to aspects of the present invention, an image forming device is provided that includes a photoconductive body, an exposure unit configured with a plurality of light emitting elements aligned in a predetermined direction, the exposure unit being adopted to expose the photoconductive body to light emitted by the light emitting elements, a frame configured to support both sides of the exposure unit in the predetermined direction, the frame having a reference portion configured to position the exposure unit in the predetermined direction in contact with an end of the exposure unit in the predetermined direction, and a pressing member provided to one of the frame and the exposure unit, the pressing member being configured to press the end of the exposure unit against the reference portion.

In some aspects of the present invention, an end of the exposure unit is pressed by the pressing member against the reference portion. Therefore, it is possible to position, relative to the frame, the exposure unit in the predetermined direction in which the light emitting elements of the exposure units are aligned.

BRIEF DESCRIPTION OF THE ACCOMPANYING DRAWINGS

DETAILED DESCRIPTION

It is noted that various connections are set forth between elements in the following description. It is noted that these connections in general and, unless specified otherwise, may be direct or indirect and that this specification is not intended to be limiting in this respect.

Hereinafter, an embodiment according to aspects of the present invention will be described with reference to the accompany drawings.

In the following description, directions will be defined based on a viewpoint of a user who uses a color printer in an embodiment. Specifically, a left side in FIG. 1 is defined as a "front side." A right side in FIG. 1 is defined as a "rear side." A far side in FIG. 1 is defined as a "left side." A near side is defined as a "right side." Further, a vertical direction in FIG. 1 is also defined as a "vertical direction."

Figure 1:
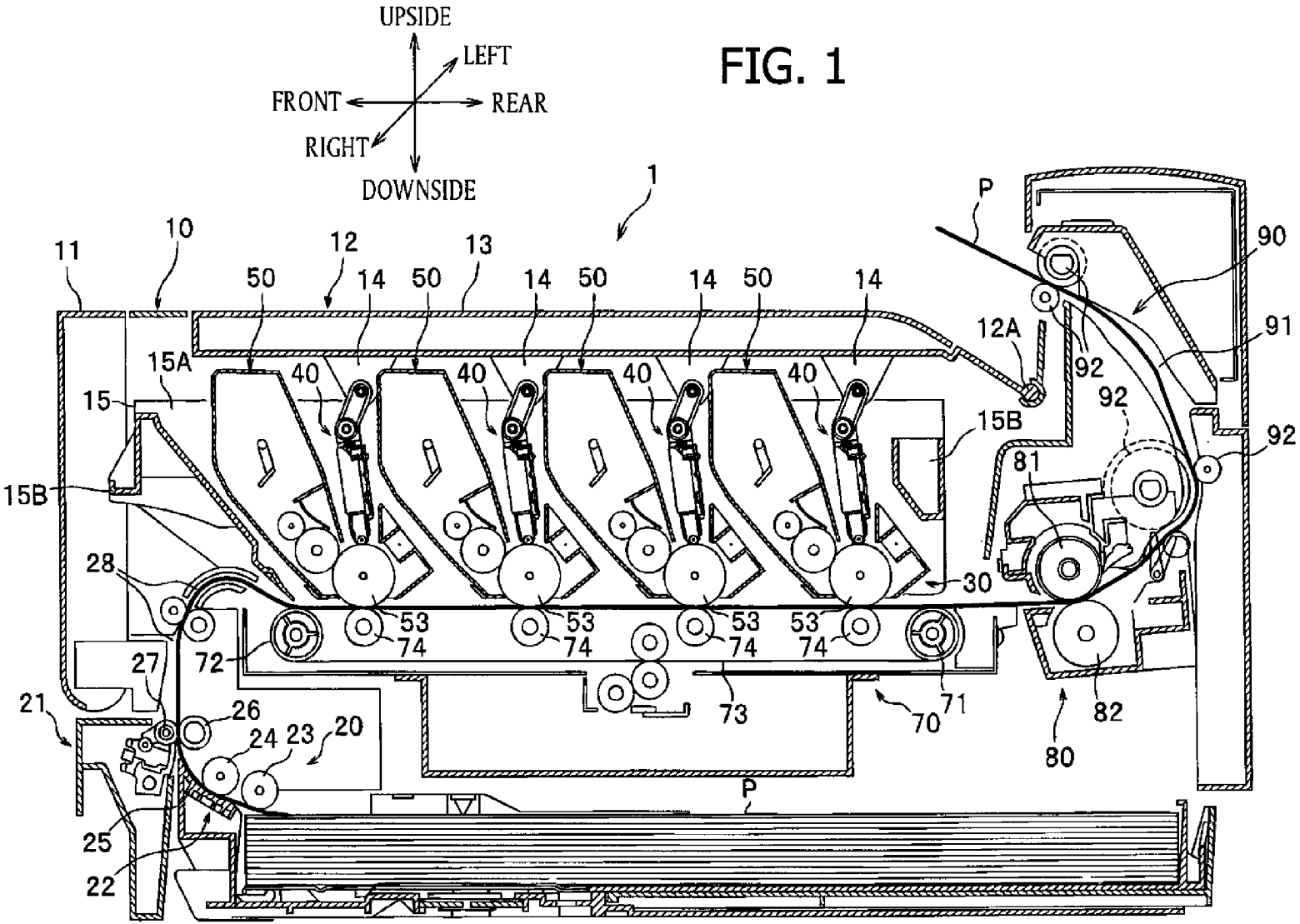
FIG. 1 is a cross-sectional side view schematically showing an overall configuration of a color printer in an embodiment according to one or more aspects of the present invention.

As shown in FIG. 1, a color printer 1 in an embodiment according to aspects of the present invention includes, in a main body housing 10, a sheet feed unit 20 configured to feed a sheet P, an image forming unit 30 configured to form an image on the sheet P fed, and a sheet ejecting unit 90 configured to eject the sheet P with the image formed thereon.

The color printer 1 has an upper cover 12 at an upper side of the main body housing 10, which is a cover configured to be openable and closable relative to the main body housing 10. More specifically, the upper cover is adopted to be swingable in the vertical direction around a hinge 12A provided at a rear side as a supporting point. The upper cover 12 has an upper face configured as a catch tray 13 to be loaded with the sheet P ejected from the main body housing 10 and a lower face provided with a plurality of LED attachment members 14 configured to hold an LED unit 40.

Further, the color printer 1 includes, in the main body housing 10, a main body frame 15 provided as a part of a device main body, which is a frame configured to house below-mentioned process cartridges 50 detachably therefrom. The main body frame 15 includes a pair of metal side frames 15A (only one of them is shown in FIG. 1) provided at left and right sides, and a pair of cross members 15B provided at the front and rear sides to connect the pair of side frames 15A therethrough. The main body frame 15 is fixed to the main body housing 10. The side frames 15A are disposed at both sides in a direction in which light emitting elements of a below-mentioned LED head 41 (FIG. 2) are aligned (hereinafter referred to as a main direction, which is identical to an axial direction of photoconductive drums 53 in the embodiment). Further, the side frames 15A are configured to support the photoconductive drums 53 directly or indirectly and to position the photoconductive drums 53.

The sheet feed unit 20 is provided at a lower side in the main body housing 10. Further, the sheet feed unit 20 includes a sheet feed tray 21 detachably attached to the main body housing 10, and a sheet supply mechanism 22 adopted to convey the sheet P from the sheet feed tray 21 to the image forming unit 30. The sheet supply mechanism 22 is provided at a front side of the sheet feed tray 21, and includes a feed roller 23, a separation roller 24, and a separation pad 25.

In the sheet feed unit 20 configured as above, the sheet P in the sheet feed tray 21 is fed upward on a sheet-by-sheet basis. Then, while the sheet P passes between a sheet powder removing roller 26 and a pinch roller 27, sheet powder is removed from the sheet P. Thereafter, the sheet P is turned rearward through a sheet carrying route 28 and supplied to the image forming unit 30.

The image forming unit 30 includes four LED units 40, four process cartridges 50, a transfer unit 70, and a fixing unit 80.

Figure 2:
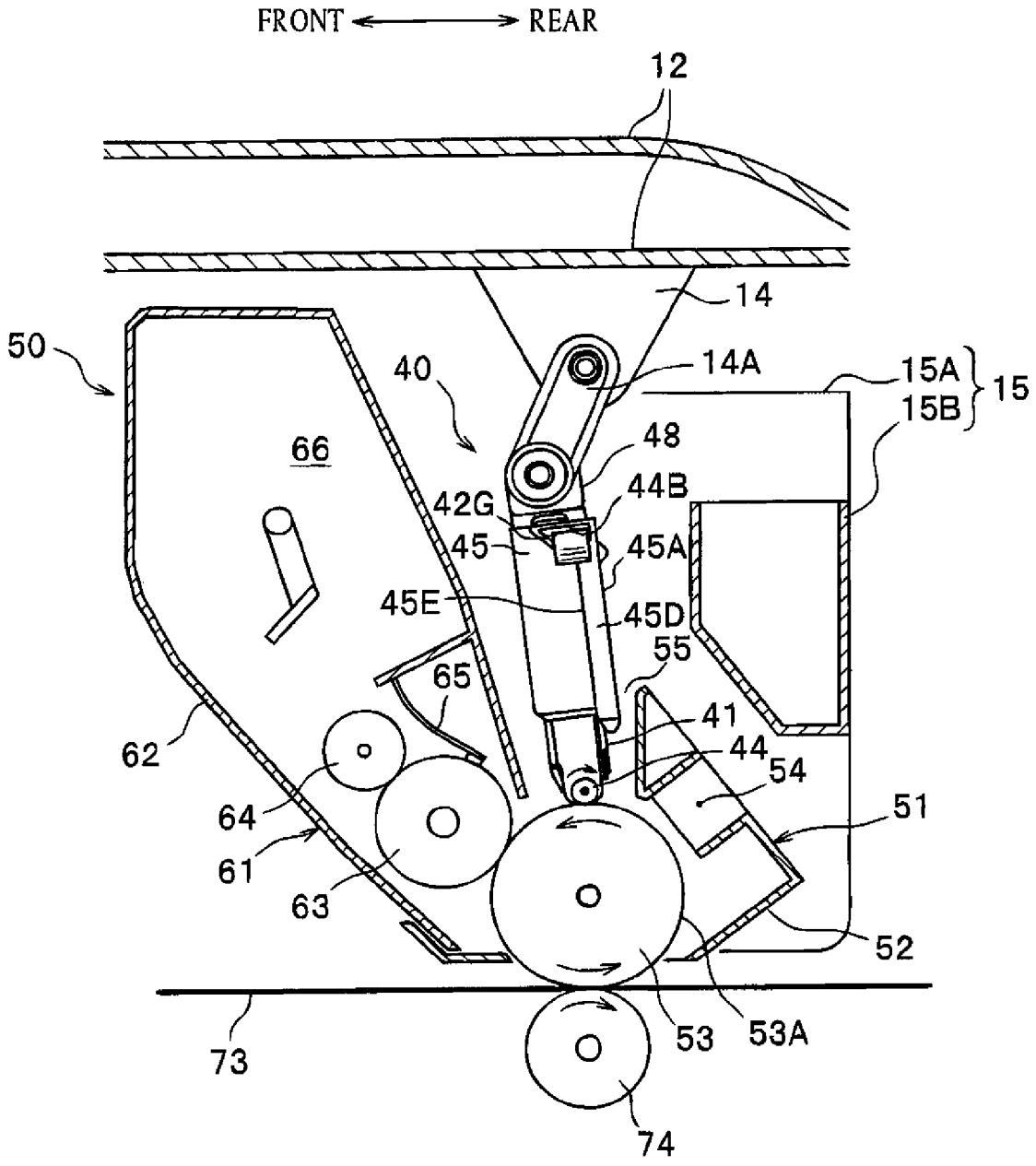
FIG. 2 is an enlarged cross-sectional side view showing an LED unit and a process cartridge of the color printer in the embodiment according to one or more aspects of the present invention.

The process cartridges 50 are aligned in a front-to-rear direction between the upper cover 12 and the sheet feed unit 20. As illustrated in FIG. 2, each of the process cartridges 50 includes a drum unit 51 and a development unit 61 detachably attached to the drum unit 51. The process cartridge 50 is supported by the side frames 15A. Further, the process cartridge 50 supports the photoconductive drum 53. It is noted that the process cartridges 50 have the same configuration except for respective different colors of toners stored in below-mentioned toner containers 66 of the development units 61.

The drum unit 51 includes a drum frame 52, a photoconductive drum 53 as a photoconductive body rotatably supported by the drum frame 52, and a scorotron charger 54.

The development unit 61 includes a development frame 62, a development roller 63 and a supply roller 64 that are rotatably supported by the development frame 62, a layer thickness regulating blade 65, and a toner container 66. The process cartridge 50 has an exposure hole 55 formed between the development frame 62 and the drum frame 52 when the development unit 61 is attached to the drum unit 51. The photoconductive drum 53 is disposed at a lower side of the exposure hole 55. Further, by the LED unit 40 being inserted into the exposure hole 55, the LED unit 40 is disposed to face the photoconductive drum 53.

As illustrated in FIG. 1, the transfer unit 70 is provided between the sheet feed unit 20 and each process cartridge 50, and includes a driving roller 71, a driven roller 72, a carrying belt 73, and transfer rollers 74.

The driving roller 71 and the driven roller 72 are disposed in parallel to be kept away from one another in the front-to-rear direction. The carrying belt 73 is configured as an endless belt to be hung around the driving roller 71 and the driven roller 72. The carrying belt 73 is provided with an outer surface thereof in contact with each of the photoconductive drums 53. Further, inside the carrying belt 73, four transfer rollers 74 are disposed to face the respective photoconductive drums 53 via the carrying belt 73 and to pinch the carrying belt 73 with the respective photoconductive drums 53. A transfer bias is applied to the transfer rollers 74 under constant electrical current control in a transfer operation.

The fixing unit 80 is disposed at a rear side relative to the process cartridges 50 and the transfer unit 70. Further, the fixing unit 80 includes a heating roller 81 and a pressing roller 82 that is disposed to face the heating roller 81 via the sheet P being carried and configured to press the sheet P against the heating roller 81.

In the image forming unit 30 configured as above, firstly a surface of each photoconductive drum 53 is evenly charged by the scorotron charger 54, and subsequently exposed to LED light emitted by each LED unit 40. Thereby, on each photoconductive drum 53, an electrical potential of an exposed portion is lowered, and an electrostatic latent image is formed based on image data.

In addition, toner in the toner container 66 is supplied to the development roller 63 along with rotation of the supply roller 64, and comes into between the development roller 63 and the layer thickness regulating blade 65 along with rotation of the development roller 63. Thereby, the toner is held on the development roller 63 as a thin layer with an even thickness.

The toner held on the development roller 63 is supplied to the electrostatic latent image formed on the photoconductive drum 53 through contact between the development roller 63 and the photoconductive drum 53. Thereby, the toner is selectively held on the photoconductive drum 53. Namely, the electrostatic latent image is visualized, and a toner image is formed by inversion development.

Subsequently, when the sheet P fed onto the carrying belt 73 passes between each photoconductive drum 53 and each transfer roller 74 disposed inside the carrying belt 73, the toner image formed on each photoconductive drum 53 is transferred onto the sheet P. Then, when the sheet P passes between the heating roller 81 and the pressing roller 82, the toner image transferred onto the sheet P is thermally fixed.

The sheet ejecting unit 90 is configured to extend upward from an exit of the fixing unit 80 and provided with a sheet ejecting route 91 formed to turn around frontward and carrying rollers 92 configured to carry the sheet P. The sheet P with the toner image transferred and fixed thereon is conveyed on the sheet ejecting route 91 by the carrying rollers 92. Thereafter, the sheet P is discharged outside the main body housing 10 and stacked on the catch tray 13.

<Configuration of LED Unit>

Figures 3A, 3B:
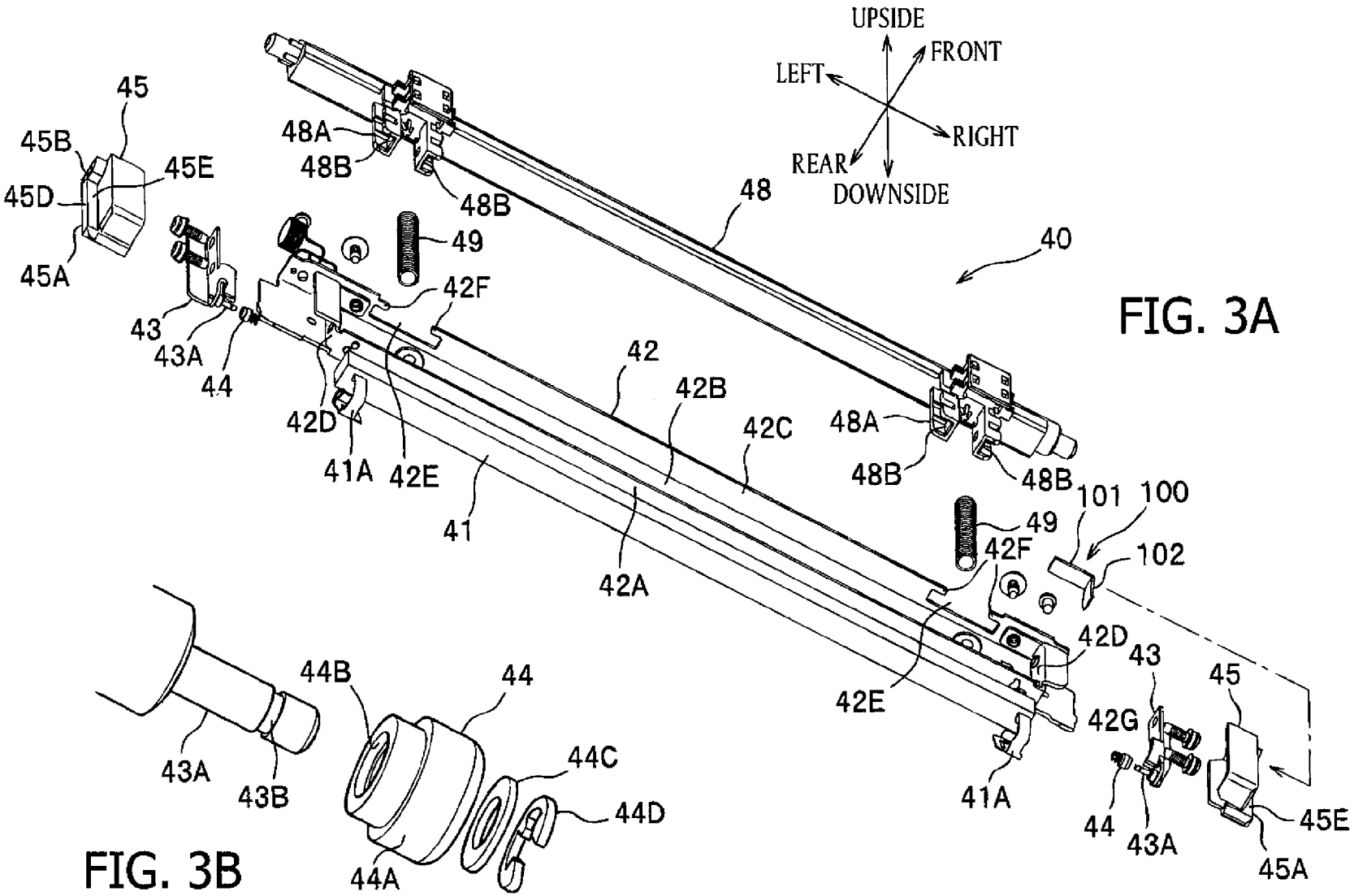
FIG. 3A is an exploded perspective view showing the LED unit in the embodiment according to one or more aspects of the present invention.
FIG. 3B is an enlarged perspective view showing a guide roller in the embodiment according to one or more aspects of the present invention.

Subsequently, the LED unit 40 and a configuration for earthing the LED unit 40 will be described in detail. As illustrated in FIG. 3A, the LED unit 40 includes the LED head 41, an exposure unit frame 42, roller supporting members 43, guide rollers 44, resin covers 45, and suspenders 48.

The LED head 41 includes a plurality of LEDs (light emitting elements) aligned in the left-to-right direction (in a longitudinal direction of the LED head 41) on a lower side of the LED head 41. More specifically, the LED head 41 has a head structure in which a supporting body supports a plurality of LEDs (light emitting elements) that are aligned in conformity with a predetermined pixel interval and configured to be selectively driven and expose the surface of the photoconductive drum 53. Hereinafter, the longitudinal direction of the LED head 41 will be referred to as a main direction. Further, a direction perpendicular to the main direction and an exposure direction (see an arrow X in FIG. 5) of the LEDs, namely, a front-to-rear direction in which the photoconductive drums 53 are aligned will be referred to as an auxiliary direction. An exterior of the LED head 41 is formed from resin to avoid discharge from high voltage components such as the scorotron charger 53. Each light emitting element receives a signal issued by a control unit (not shown) based on image data of an image to be formed, emits light in accordance with the signal received, and exposes the photoconductive drum 53 to the light emitted.

The exposure unit frame 42 is a frame configured to support the LED head 41. The exposure unit frame 42 is formed by pressing a metal plate to have a substantially rectangular U-shaped cross-section. Therefore, the exposure unit frame 42 has electrical conductivity. The exposure unit frame 42 is formed to be longer than the LED head 41 in an axial direction of the photoconductive drum 53, namely, in the left-to-right direction. Specifically, the exposure unit frame 42 is a member which is formed with a lower plate 42A, a side plate 42B, and an upper plate 42C, to extend in the left-to-right direction with the rectangular U-shaped cross-section. The lower plate 42A has end plates 42D formed at both ends in the left-to-right direction by bending the ends thereof. The upper plate 42C has openings 42E formed near the both ends thereof to open toward the front side. Each opening 42E has engagement claws 42F formed at front ends thereof, which extend inward in the left-to-right direction to narrow the opening 42E. The LED head 41 is attached and fixed to the exposure unit frame 42 with two clips 41A such that an upper face of the LED head 41 establishes close contact with the lower plate 42A of the exposure unit frame 42.

At a right end of the upper plate 42C of the exposure unit frame 42, a leaf spring 100 is provided, which is configured to apply a biasing force for pulling a right end of the LED head 41 toward the side frames 15A (specifically, a below-mentioned contact portion 161B of a front guide 161; see FIG. 5). The leaf spring 100 is formed by bending an electrically conductive metal plate substantially into an L-shape. The leaf spring 100 has a first wall 101 and a second wall 102. It is noted that, when the leaf spring 100 is provided to the exposure unit frame 42 as described above, the leaf spring 100 moves from upside to down side toward the below-mentioned contact portion 161B along with movement of the LED unit 40 to an exposure position. Thereby, the leaf spring 100 can press an end of the LED unit 40 (a below-mentioned main direction positioning surface 45D) against the contact portion 161B.

The first wall 101 is formed in a plate shape that allows the first wall 101 to be inserted into a below-mentioned through-hole 45B of the resin cover 45. Further, the first wall 101 is inserted from outside the through hole 45B of the resin cover 45 and fixed to an upper face of the upper plate 42C of the exposure unit frame 42.

Figure 5:
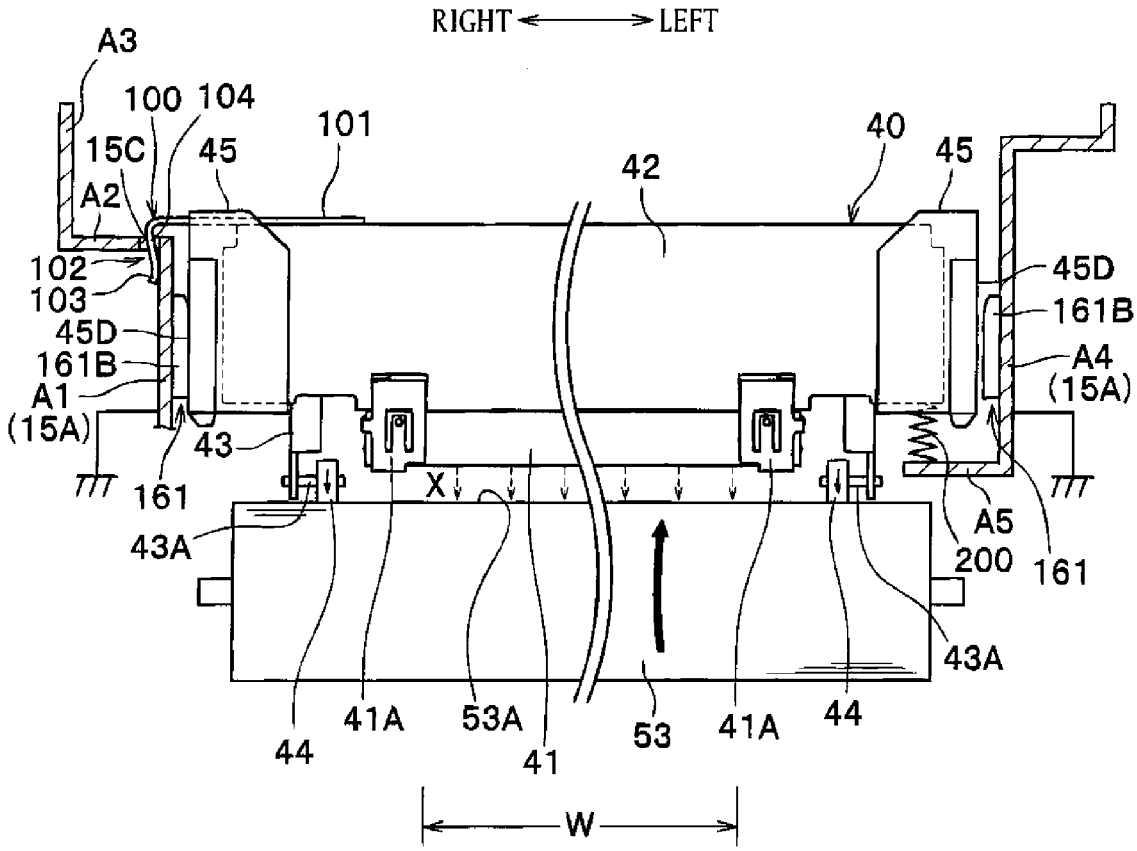
FIG. 5 is a rear view showing a photoconductive drum and the LED unit in the embodiment according to one or more aspects of the present invention.

As illustrated in FIG. 5, the second wall 102 has a distal end portion 103 and a body portion 104. The body portion 104 of the second wall 102 is inclined relative to a side frame 15A (a first vertical wall A1) so as to be gradually closer to the exposure unit frame 42 downward in a state where the first wall 101 is fixed to the exposure unit frame 42. In addition, the distal end portion 103 of the second wall 102 is inclined relative to the side frame 15A (the first vertical wall A1) so as to be farther away from the exposure unit frame 42 downward. Therefore, when the LED unit 40 is moved from an evacuation position to the exposure position, and the distal end portion 103 of the second wall 102 comes into contact with the below-mentioned first vertical wall A1 of the side frame 15A, the second wall 102 is pushed outside by the first vertical wall A1.

As shown in FIG. 3A, Each roller supporting member 43 is a bracket formed by pressing an electrically conductive metal plate, and fixed to a corresponding one of the end plates 42D at the both ends of the exposure unit frame 42 with screws. The roller supporting member 43 is provided with a roller shaft 43A at a lower end thereof, which is a shaft extending inward in the left-to-right direction. The roller shaft 43A is configured to rotatably support the guide roller 44, and provided with an engagement groove 43B formed in a circumferential direction thereof as shown in FIG. 3B.

The guide roller 44 is a substantially cylindrical roller to maintain a gap between the LED head 41 and the photoconductive drum 53. Specifically, the guide roller 44 has a cylindrical rolling surface 44A. An axis hole 44B is formed on a central axis of the rolling surface 44A, which is a hole adopted such that the roller shaft 43A is fitted therein. The guide roller 44 is attached to the roller shaft 43A in a state where the roller shaft 43A is inserted into the axis hole 44B and a washer 44C and where the engagement groove 43B is engaged with a clip 44D. Namely, a direction in which the roller shaft 43A extends is identical to a rotational axis direction of the guide roller 44.

As illustrated in FIG. 2, by rolling in contact with a circumferential surface 53A of the photoconductive drum 53, the guide roller 44 defines positional relationship between the LED unit 40 and the photoconductive drum 53, more specifically, a distance between the light emitting elements of the LED head 41 and the circumferential surface 53A. Any material can be employed for the guide roller 44. However, a material which has an appropriate frictional coefficient with the circumferential surface 53A and an excellent wear resistance is preferable. For example, a polyamide resin may be employed for the guide roller 44. The guide roller 44 is disposed outside an image forming range (indicated by a reference character W in FIG. 5) which is supplied with toner on the circumferential surface 53A of the photoconductive drum 53.

As illustrated in FIG. 3A, the resin covers 45 are configured to cover metal portions at both ends of the exposure unit frame 42. The two resin covers 45 provided at left and right sides are formed to be bilaterally-symmetric. The resin covers 45 are formed from insulating resin so as to cover both end faces and portions within a predetermined range from the both ends of the exposure unit frame 42. Each resin cover 45 has a guide rib 45A formed to protrude from an outer end of the resin cover 45 in the left-to-right direction and extend in the vertical (upside-to-downside) direction. The guide rib 45A has an upper end with a contour substantially triangle when viewed from the outside in the left-to-right direction. The through-hole 45B is formed inside the triangle upper end. The aforementioned first wall 101 of the leaf spring 100 is inserted into the through-hole 45B (not shown) of the right resin cover 45.

An outer surface of the guide rib 45A in the left-to-right direction is the main direction positioning surface 45D. The main direction positioning surface 45D is adopted to contact the side frame 15A in the main direction and position the LED unit 40 in the main direction. A front face of the guide rib 45A is an auxiliary direction positioning surface 45E. The auxiliary direction positioning surface 45E is adopted to contact the side frame 15A in the auxiliary direction and to position the LED unit 40 in the auxiliary direction.

The suspender 48 is a member configured to support the exposure unit frame 42 and the LED head 41 in a suspended state. The suspender 48 is formed to be as long in the left-to-right direction as the exposure unit frame 42. Further, the suspender 48 has engagement members 48A provided in two positions that correspond to the two openings 42E. Each engagement member 48A includes portions (hereinafter, each of which will be referred to as an opening 48B with a rectangular U-shaped cross-section) each of which has a rectangular U-shaped cross-section that opens outside in the left-to-right direction when viewed from beneath. The opening 48B with the rectangular U-shaped cross-section is configured to engage with a corresponding one of the aforementioned engagement claws 42F with some allowance.

A compression spring 49 is provided between each engagement member 48A and the exposure unit frame 42. The compression spring 49 is disposed on an inner side relative to the guide roller 44 in the left-to-right direction. When the engagement member 48A is engaged with the opening 42E and the engagement claws 42F of the exposure unit frame 42 with some allowance, and thereafter the engagement therebetween is locked by a locking member (not shown), the exposure unit frame 42 and the LED head 41 is always biased by the compression spring toward the photoconductive drum 53.

As illustrated in FIG. 2, such an LED unit 40 is attached to the upper cover 12 via a connection link 14A and the LED attachment member 14. The connection link 14A is configured to be rotatable at a joint with the LED attachment member 14 and a joint with the LED unit 40 as shown in the side view of FIG. 2. Thereby, a posture of the LED unit 40 can flexibly be changed. Thus, it is possible to make it easy to engage the LED unit 40 with the side frames 15A.

Each of the LED units 40 extends downward from the upper cover 12 in a state attached to the upper cover 12. As mentioned above, the upper cover 12 is configured to be rotatable around the hinge 12A and to be openable and closable. Hence, the LED unit 40 is movable relative to the photoconductive drum 53 between the exposure position where the LED unit 40 is close to the photoconductive drum 53 and the evacuation position where the LED unit 40 is away from the photoconductive drum 53. In the exposure position, the guide rollers 44 provided at the lower end of the LED unit 40 establish contact with areas around an upper end of the circumferential surface 53A of the photoconductive drum 53. Thereby, a constant distance can be maintained between the circumferential surface 53A and the LED head 41.

Figure 4:
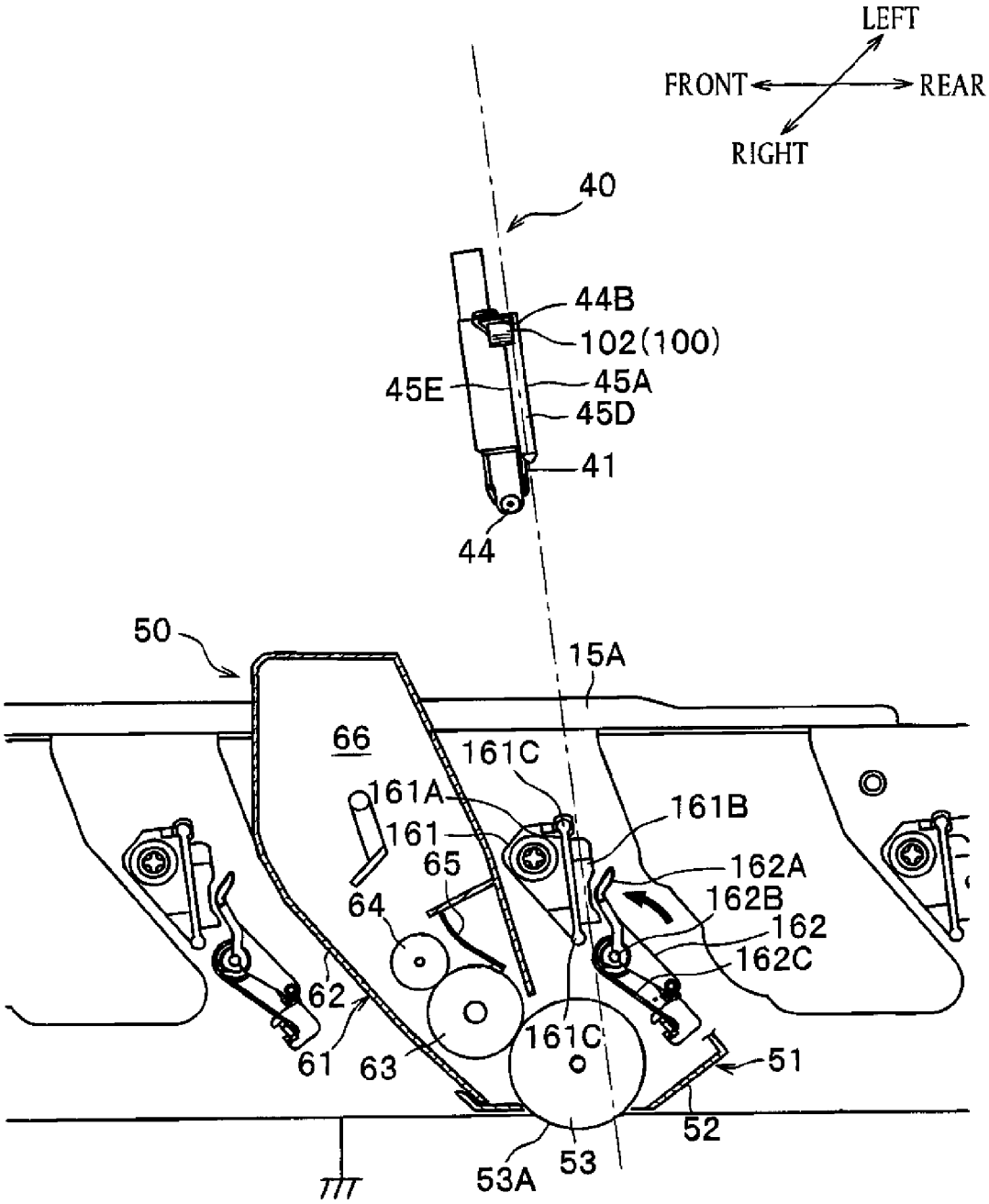
FIG. 4 is a cross-sectional side view showing a positional relationship between the LED unit and a side plate in the embodiment according to one or more aspects of the present invention.

As shown in FIG. 4, the side frames 15A have a front guide 161 and a rear guide 162 which are provided to correspond to each end in the left-to-right direction of each of the four LED units 40 in a state where the LED units 40 are attached to the side frames 15A. The front guide 161 is disposed in front of the auxiliary direction positioning surface 45E. The rear guide 162 is disposed at the rear of the auxiliary direction positioning surface 45E.

The front guide 161 includes a rib 161A formed to extend substantially in the vertical direction (the upside-to-downside direction) and protrude inward in the left-to-right direction. The rib 161A is located in front of the guide rib 45A when the LED unit 40 is attached. The rib 161A includes cylindrical portions 161C at both ends thereof in the vertical direction, which are formed to be cylindrical and thicker in the front-to-rear direction than a central portion in the vertical direction of the rib 161A. The cylindrical portions 161C are adopted to contact the auxiliary direction positioning surface 45E and to position the LED unit 40 in the auxiliary direction. In addition, the front guide 161 has the contact portion 161B formed at a rear edge thereof along the rib 161A. The contact portion 161B is a surface adopted to contact the main direction positioning surface 45D of the LED unit 40. A right one of the contact portions 161B is configured to contact an end of the LED unit 40 and regulate a position of the LED unit 40 in the left-to-right direction (see FIG. 5). Further, the contact portion 161B and the main direction positioning surface 45D are formed with respective predetermined surface smoothness levels so as to slide relative to each other. It is noted that the contact established between the contact portion 161B and the main direction positioning surface 45D may be surface contact or point contact.

The rear guide 162 has an arm 162A provided to extend upward from beneath. The arm 162A is supported by metal plates of the side frames 15A rotatably around a rotational shaft 162B. A torsion spring 162C is provided around the rotational shaft 162B. By the torsion spring 162C, the arm 162A is always biased counterclockwise in FIG. 4.

The front guide 161 and the rear guide 162 are formed from resin such that wear to be caused due to sliding contact with the LED unit 40 can be reduced.

Additionally, as illustrated in FIG. 5, the right side frame 15A is provided with the first vertical wall A1 configured to fix the front guide 161, a lateral wall A2 formed by bending an upper end of the first vertical wall A1 rightward, and a second vertical wall A3 formed by bending a right end of the lateral wall A2 upward. The lateral wall A2 has a through-hole 15C formed to engage the second wall 102 of the leaf spring 100 with a portion of the side frame 15A near the contact portion 161B of the front guide 161. Therefore, when the second wall 102 of the leaf spring 100 is inserted into the through-hole 15C and engaged with the first vertical wall A1 of the side frame 15A, the second wall 102 of the leaf spring 100 biases the side frame 15A toward the LED unit 40, and a right end of the LED unit 40 (the main direction positioning surface 45D) is pulled toward the contact portion 161B of the front guide 161 to contact the contact portion 161B. Namely, the side frame 15A and the contact portion 161B of the front guide 161 is pinched between the second wall 102 of the leaf spring 100 and the right end of the LED unit 40 in the left-to-right direction. It is noted that, at this time, a predetermined gap is formed between the left end of the LED unit 40 and the contact portion 161B of the front guide 161 of the left side frame 15A.

In addition, the left side frame 15A is provided with a vertical wall A4 to which the front guide 161 is fixed and a pedestal wall AS formed by bending a lower end of the vertical wall A4 rightward. Further, a coil spring 200 is provided between the pedestal wall AS and the exposure unit frame 42 of the LED unit 40, which is a spring configured to bias the LED unit 40 in such a direction as to take the LED unit 40 farther away from the photoconductive drum 53. The coil spring 200 is formed from electrically conductive material such as metal. Each of the side frames 15A is electrically earthed. In addition, a lower end of the coil spring 200 is fixed to the pedestal wall A5.

Subsequently, effects of the color printer 1 configured as above will be described. As illustrated in FIG. 1, at the time of replacement or maintenance of the process cartridge 50 of the color printer 1, firstly the upper cover 12 is opened up, and the LED unit 40 is moved from the exposure position to the evacuation position.

According to the color printer 1 in the embodiment, thus the LED unit 40 is movable relative to the photoconductive drum 53 between the exposure position and the evacuation position. Hence, the LED unit 40 has to be positioned relative to the photoconductive drum 53.

After completing the maintenance, the upper cover 12 is closed down. At this time, as shown in FIG. 2, the guide roller 44 provided at the lower end of the LED unit 40 comes into contact with the circumferential surface 53A of the photoconductive drum 53. Thereby, the distance between the circumferential surface 53A and the light emitting elements of the LED head 41 is kept constant.

At this time, as illustrated in FIG. 4, the guide rib 45A is inserted into between the rib 161A of the front guide 161 and the arm 162A of the rear guide 162. The arm 162A is biased forward by the torsion spring 162C, and thereby the guide rib 45A is biased forward. Thus, the auxiliary direction positioning surface 45E of the guide rib 45A contacts the cylindrical portions 161C at the both ends of the rib 161A, and the LED unit 40 is positioned in the auxiliary direction.

Further, at this time, as illustrated in FIG. 5, the second wall 102 of the leaf spring 100 provided to the LED unit 40 is inserted into the through-hole 15C of the right side frame 15A, and engages with the outer face of the first vertical wall A1 with the lower end thereof bowing rightward. Thereby, by the biasing force of the second wall 102 of the leaf spring 100, the main direction positioning surface 45D of the LED unit 40 is pulled rightward and comes into contact with the contact portion 161B of the front guide 161. Thus the LED unit 40 is positioned in the main direction.

In the aforementioned positioning of the LED unit 40 in the main direction, the exposure unit frame 42 is electrically earthed via the leaf spring 100 and the (right) side frame 15A and via the coil spring 200 and the (left) side frame 15A.

According to the color printer 1 configured as above, the following effects can be obtained in the embodiment. By the leaf spring 100, the main direction positioning surface 45D at the right side of the LED unit 40 is biased to be pulled toward the contact portion 161B of the front guide 161 provided to the right side frame 15A. Therefore, the LED unit 40 can be positioned relative to the right side frame 15A in the main direction. Further, the leaf spring 100 is provided only to one end of the LED unit 40. Therefore, for instance, compared with a color printer configured such that respective coil springs with different biasing forces are provided at the both ends of an LED unit and that the LED unit is pressed against a side frame by a coil spring with a grater biasing force, the color printer 1 of the embodiment can relatively reduce distortion of the side frame.

Further, in the embodiment, the leaf spring 100 with an elastic property is employed as a pressing member adopted to press the LED unit 40 against the contact portion 161B of the side frame 15A. Therefore, since the LED unit 40 can be positioned with such a simple structure, it is possible to reduce costs for manufacturing the color printer 1.

Further, in the embodiment, the contact portion 161B of the front guide 161 and the main direction positioning surface 45D of the LED unit 40 are configured to be slidable relative to each other. Therefore, even though the photoconductive drum 53 is formed somewhat in an oval shape within a manufacturing tolerance, it is possible to maintain definite contact of the guide rollers 44 with the circumferential surface 53A of the photoconductive drum 53 by smoothly moving the LED unit 40 in the vertical direction. For this reason, it is possible to certainly keep a constant distance between the LED head 41 and the photoconductive drum 53.

Further, in the embodiment, the exposure unit frame 42 is electrically earthed via the leaf spring 100, the coil spring 200, and the side frames 15A. Therefore, even when the LED head 41 formed with the resin exterior is employed, the LED head 41 can be earthed via the metal exposure unit frame 42 in close contact with the upper face of the LED head 41. Thereby, electric charges can sufficiently be removed from the surface of the LED head 41. In addition, even though an electromagnetic wave is generated due to a large current flowing in the LED head 41, the exposure unit frame 42 is formed to be longer in the left-to-right direction than the LED head 41, and the LED head 41 has the metal side frames 15A provided at the both ends thereof in the left-to-right direction. Thus, the electromagnetic wave is enough absorbed by the exposure unit frame 42 and the side frames 15A, and it is possible to avoid influence of the electromagnetic wave on other devices. Especially, in the embodiment, since the aforementioned configuration is applied to the both ends of the LED head 41 in the left-to-right direction, the earth connection and the absorption of the electromagnetic wave can enough be made. Further, in the embodiment, since the leaf spring 100 is used for the positioning of the LED head 41 in the main direction, the positioning of the LED head 41, the earth connection of the LED head 41, and the blocking of the electromagnetic wave can concurrently be performed. Additionally, since the LED head 41 has the resin exterior, it is possible to downsize the LED head 41, enhance flexibility in layout design around the photoconductive drum 53, and thus downsize the color printer 1.

Hereinabove, the embodiment according to aspects of the present invention have been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Only an exemplary embodiment of the present invention and but a few examples of its versatility are shown and described in the present disclosure. It is to be understood that the present invention is capable of use in various other combinations and environments and is capable of changes or modifications within the scope of the inventive concept as expressed herein. For example, the present invention is capable of the following modifications.

Figure 6:
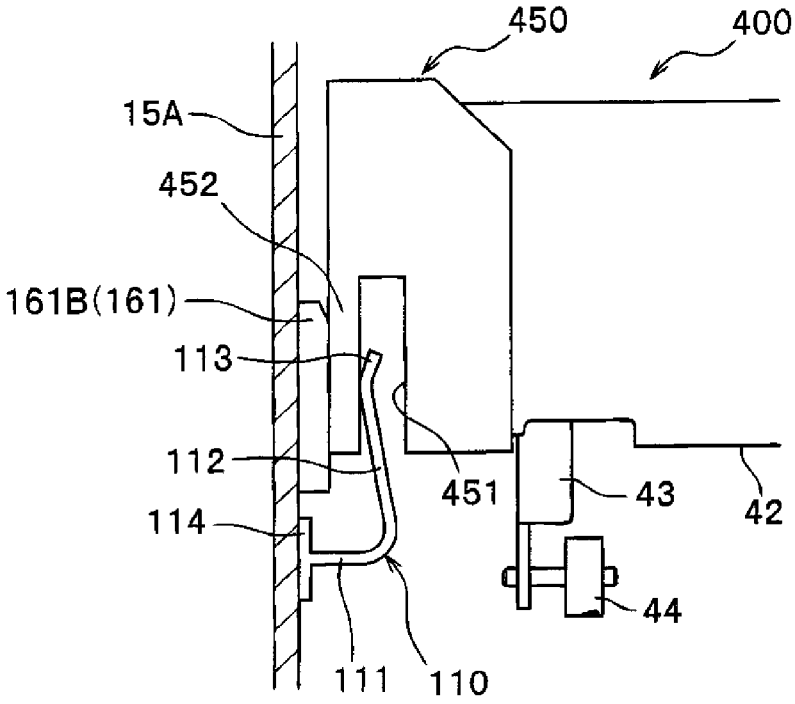
FIG. 6 is a schematic diagram showing a leaf spring provided inside a side frame in a modification according to one or more aspects of the present invention.
Figure 7:
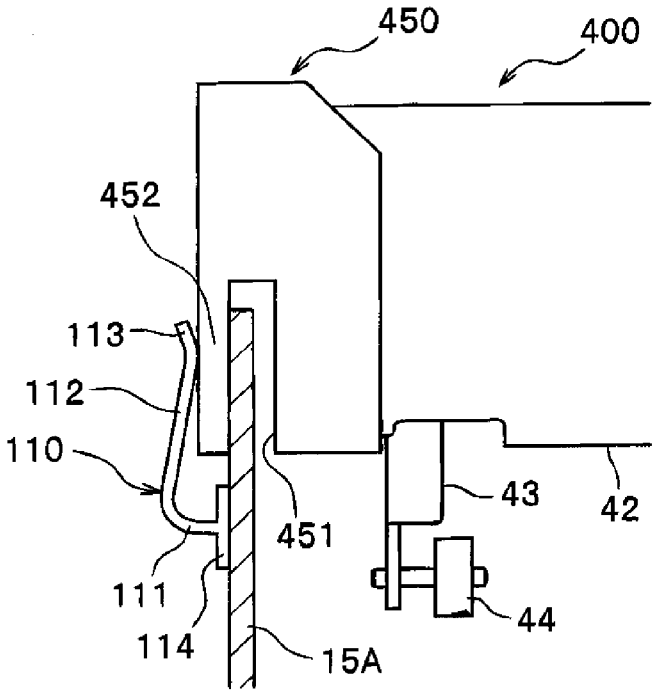
FIG. 7 is a schematic diagram showing a leaf spring provided outside a side frame in a modification according to one or more aspects of the present invention.

In the aforementioned embodiment, the leaf spring 100 is provided to the LED unit 40. However, for example, as shown in FIG. 6 or 7, a leaf spring 110 may be provided to the right side frame 15A. It is noted that, in FIGS. 6 and 7, the same reference characters will be given to the same elements as the aforementioned embodiment, and explanation regarding them will be omitted. Additionally, although the left side frame 15A is not shown in any of FIGS. 6 and 7, the leaf spring 110 is not provided to the left side frame 15A in the same manner as the aforementioned embodiment (see FIG. 5). Further, a gap is formed between the left side frame 15A and an LED unit 400.

Specifically, the leaf spring 110 shown in FIG. 6 is configured with the leaf spring 100 in the aforementioned embodiment disposed upside down. Further, in addition to a first wall 111, a second wall 112, and a distal end portion 113 configured in substantially the same manner as the aforementioned embodiment, the leaf spring 110 shown in FIG. 6 includes a fixing portion 114 for fixing the first wall 111 to the side frame 15A. Additionally, when the leaf spring 110 is fixed to an inner face of the side frame 15A, the distal end portion 113 of the leaf spring 110 is disposed on an inner side of the contact portion 161B of the front guide 161 fixed to the side frame 15A in the left-to-right direction.

Further, in this structure, the LED unit 400 has a resin cover 450 different from the resin cover 45 of the LED unit in the aforementioned embodiment. Specifically, the resin cover 450 has a recessed portion 451 formed on a lower face thereof so as to open downward. Thereby, a projecting wall 452 is formed at an outer side of the resin cover in the left-to-right direction so as to protrude downward.

The projecting wall 452 is configured such that an outer face thereof contacts the contact portion 161B when being sandwiched between the contact portion 161B of the front guide 161 and the distal end portion 113 of the leaf spring 110 in the exposure position. Thereby, the LED unit 400 can be positioned in the main direction.

Further, as illustrated in FIG. 7, the leaf spring 110 may be fixed to the outer face of the side frame 15A. In this case, when the aforementioned projecting wall 452 of the resin cover 450 is sandwiched between the distal end portion 113 of the leaf spring 110 and the side frame 15A, the projecting wall 452 is biased by the leaf spring 110. Thereby, the projecting wall 452 establishes contact with the outer face of the side frame 15A. It is noted that, in this modification, the LED unit 400 can be positioned in the main direction with the outer face of the side frame 15A employed as a reference for the positioning.

Figure 8:
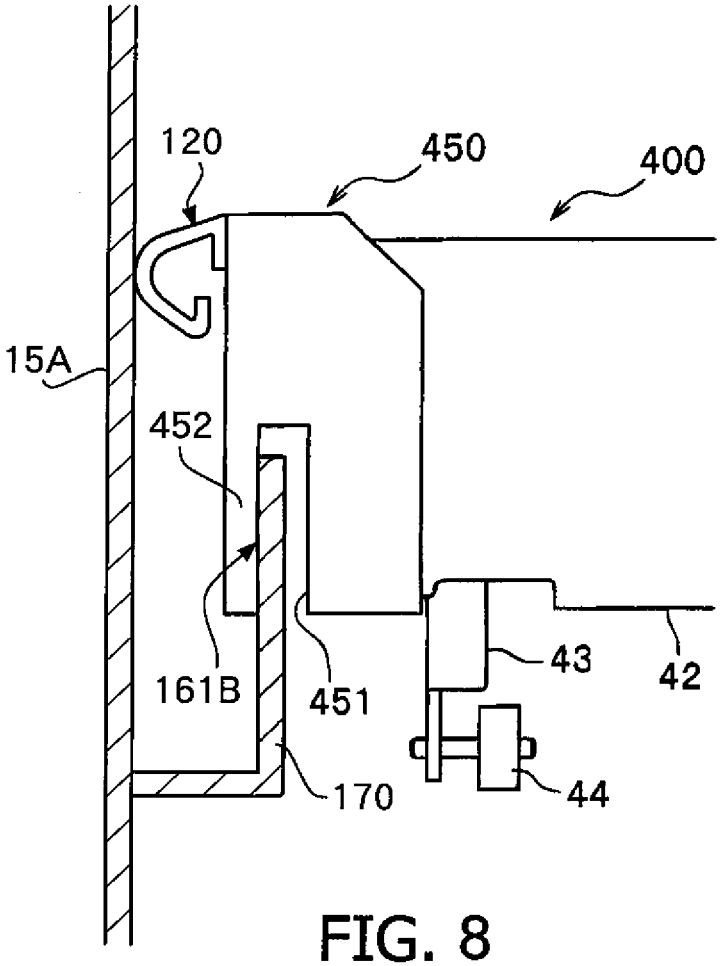
FIG. 8 is a schematic diagram showing a spring provided outside an LED unit in a modification according to one or more aspects of the present invention.

Further, as illustrated in FIG. 8, a spring 120 may be fixed to an outer side face of the resin cover 450. In this case, the side frame 15A includes a bending portion 170 configured to extend from an inner side of the side frame 15A and then bend upward. The bending portion 170 has a contact surface adopted to establish contact with the projecting wall 452 when the outer side face of the resin cover 450 is urged by the spring 120 relative to the side frame 15A. It is noted that, in this modification, the LED unit 400 can be positioned in the main direction with the contact surface of the bending portion 170 employed as a reference for the positioning.

In the aforementioned embodiment, the leaf spring 100 is employed as a pressing member. However, for example, a torsion spring may be employed as substitute for the leaf spring 100. Further, a diaphragm spring or a leaf spring may be applied as substitute for the compression spring 49 or the coil spring 200.

In the aforementioned embodiment, the LED head 41 configured with a plurality of LEDs is exemplified. However, an LED head may be configured with a single light emitting device such as an LED. For example, an LED head may be configured with a single back light such as a fluorescent light, and optical shutters which are configured with liquid crystals or PLZT elements and aligned linearly in the left-to-right direction outside the back light. Namely, a plurality of light emitting elements linearly aligned can be formed by combining a single light emitting device and a line of optical shutters. Additionally, the light emitting elements may be aligned not in a line but in two or more lines. Further, the light emitting device may be not only an LED but also an electroluminescence (EL) device or a fluorescent material.

The side frames 15A (main body frame 15) disposed at the both ends of the photoconductive drum 53 may be a framework of the color printer 1 or a drawer-type frame adopted to be attached and detached relative to the color printer 1 together with the process cartridges 50 in block.

In the aforementioned embodiment, aspects of the present invention are applied to the color printer 1. However, aspects of the present invention may be applied to other image forming devices such as a copy machine and a multi function peripheral.

In the aforementioned embodiment, the photoconductive drum 53 is employed as a photoconductive body. However, for example, a belt-shaped photoconductive body may be employed.

What is claimed is:

1. An image forming device, comprising:

a photoconductive drum;

an exposure unit comprising a plurality of light emitting elements aligned in a first direction, a first end portion and a second end portion opposite to the first end portion in the first direction, the exposure unit being disposed to face the photoconductive drum in a second direction perpendicular to the first direction and configured to expose the photoconductive drum;

a first frame comprising a reference portion configured to position the exposure unit in the first direction, the reference portion being in contact with the first end portion of the exposure unit in the first direction;

a second frame, the exposure unit being disposed between the first frame and the second frame in the first direction; and a metal part comprising a first portion and a second portion, the first portion being fixed to the first frame, the first end portion being sandwiched in the first direction between the second portion and the reference portion.

2. The image forming device according to claim 1, wherein the exposure unit is configured to move between an exposure position where the exposure unit is closer to the photoconductive drum and an evacuation position where the exposure unit is spaced farther away from the photoconductive drum, and wherein the metal part is configured to move toward the reference portion along with movement of the exposure unit to the exposure position, and to sandwich the first end portion of the exposure unit with the reference portion when the exposure unit is in the exposure position.

3. The image forming device according to claim 1, wherein the second end portion of the exposure unit and the second frame are configured to form a gap therebetween in the first direction when the first end portion of the exposure unit is in contact with the reference portion.

4. The image forming device according to claim 1, further comprising a biasing member configured to apply a biasing force for biasing the exposure unit toward the photoconductive drum, wherein the exposure unit includes a contact member configured to contact the photoconductive drum due to the biasing force applied by the biasing member, and wherein the exposure unit is configured to slide relative to the reference portion.

5. The image forming device according to claim 1, wherein the metal part is configured to be electrically grounded.

6. The image forming device according to claim 1, wherein the metal part includes a body portion between a bent portion and the second portion, the body portion being inclined relative to the reference portion so as to be gradually closer to the reference portion in the first direction toward the second portion.

7. The image forming device according to claim 6, wherein the metal part includes a crossing portion between the first portion and the bent portion, the crossing portion crossing the reference portion.

8. An image forming device, comprising:

a photoconductive drum;

an exposure unit comprising a plurality of light emitting elements aligned in a first direction, a first end portion and a second end portion opposite to the first end portion in the first direction, the exposure unit being disposed to face the photoconductive drum in a second direction perpendicular to the first direction and configured to expose the photoconductive drum;

a frame comprising a reference portion configured to position the exposure unit in the first direction, the reference portion being in contact with the first end portion of the exposure unit in the first direction; and a metal part comprising a first portion and a second portion, the first portion being fixed to the frame, the first end portion being sandwiched in the first direction between the second portion and the reference portion.

9. An image forming device, comprising:

a photoconductive drum;

an exposure unit comprising a plurality of light emitting elements aligned in a first direction, a first end portion and a second end portion opposite to the first end portion in the first direction, the exposure unit being disposed to face the photoconductive drum in a second direction perpendicular to the first direction and configured to expose the photoconductive drum;

a frame configured to contact the first end portion of the exposure unit in the first direction; and a metal part comprising a first portion and a second portion, the first portion being fixed to the frame, the first end portion being sandwiched in the first direction between the second portion and the frame.

* * * * *